US012781733B2

(12) United States Patent
Mascherpa et al.

(10) Patent No.: US 12,781,733 B2
(45) Date of Patent: Nov. 3, 2026

(54) SEAL FOR RECIPROCATING PUMP

(71) Applicant: Peroni Pompe S.p.A., Corsico (IT)

(72) Inventors: Luigi Mario Mascherpa, Corsico (IT); Maurizio Spagno, Corsico (IT)

(73) Assignee: Peroni Pompe S.p.A., Corsico (IT)

( * ) Notice: Subject to any disclaimer, the term of this patent is extended or adjusted under 35 U.S.C. 154(b) by 69 days.

(21) Appl. No.: 18/869,040

(22) PCT Filed: May 26, 2023

(86) PCT No.: PCT/IB2023/055422

§ 371 (c)(1),
(2) Date: Nov. 25, 2024

(87) PCT Pub. No.: WO2023/228145

PCT Pub. Date: Nov. 30, 2023

(65) Prior Publication Data

US 2025/0341210 A1 Nov. 6, 2025

(30) Foreign Application Priority Data

May 27, 2022 (IT) ..... 102022000011210

(51) Int. Cl.
*F04B 53/14* (2006.01)
*F04B 53/02* (2006.01)
*F04B 53/16* (2006.01)

(52) U.S. Cl.
CPC ..... *F04B 53/143* (2013.01); *F04B 53/02* (2013.01); *F04B 53/164* (2013.01)

(58) Field of Classification Search
CPC ..... F04B 53/02; F04B 53/164; F04B 53/143
See application file for complete search history.

(56) References Cited

U.S. PATENT DOCUMENTS 3,698,726 A * 10/1972 Schettler ..... F16J 15/26 277/540
11,879,447 B2 * 1/2024 Zhou ..... F16J 15/166
12,313,052 B2 * 5/2025 Martin ..... F16J 15/26
2009/0114086 A1 5/2009 Feraille
2013/0292909 A1 * 11/2013 Quarmby ..... F16J 15/166 277/584

OTHER PUBLICATIONS

Search report and written opinion dated Jul. 11, 2023; International Application No. PCT/IB2023/055422; 11 pages.

* cited by examiner

*Primary Examiner* — Abiy Teka
(74) *Attorney, Agent, or Firm* — RANKIN, HILL & CLARK LLP; Erik J. Overberger

(57) ABSTRACT

A seal (1) for a reciprocating pump (2) that can be applied to a rod (3) of a piston (4) comprises a casing (5) with a first opening (6), a second opening (8) and a main cavity (9) between the first (6) and the second opening (8). The casing (5) also has a plurality of annular housings (10) distributed along the main development axis (X-X), external and concentric with respect to the main cavity (9). The seal (1) comprises a plurality of sealing modules (11) each comprising a sealing ring (12), configured to be brought into contact with the rod (3) of the piston (4), and a resilient element (14), configured to hold the respective sealing ring (12) adhering to the rod (3) of the piston (4). The sealing ring (12) and the resilient element (14) are inserted into the respective annular housing (10).

16 Claims, 7 Drawing Sheets

SEAL FOR RECIPROCATING PUMP

TECHNICAL FIELD

The present invention relates to a seal for a reciprocating pump, i.e. a seal for a pump within which a piston slides along a main axis in a reciprocating manner.

In particular, the reciprocating pump is applicable in all industrial sectors in which it is necessary to move pressurized fluids, including for example the chemical, petrochemical and extractive sectors.

BACKGROUND ART

Reciprocating pumps are known in the prior art. A reciprocating pump of known type comprises a plurality of cylinders. Each cylinder comprises a chamber for a working liquid, isolated from the external environment by a seal, an inlet valve and an outlet valve inside the chamber and a piston that flows with a reciprocating motion inside it. In a suction phase, the inlet valve opens, introducing the working liquid into the chamber, while the outlet valve remains closed. Instead, in a compression phase the inlet valve closes. The piston pushes the working liquid towards the outlet valve which, by opening, allows the working liquid to exit the chamber.

To avoid leakage during operation of the piston, it is known practice to apply a seal around the piston rod. The seal comprises a gland seal having a cavity within which the piston rod slides. A packing is placed inside the cavity around the piston rod. The packing comprises a network of wires, made for example of Kevlar, Teflon or graphite placed in contact with the surface of the piston rod. Before starting the pump, the packing is inserted inside the cavity of the gland seal and compressed on the piston rod by tightening a closure element of the gland seal.

Document US2013292909A1 discloses seal assemblies comprising elements with which a mud delivery pipe of a drill is connected to a rotary driving means of the drill, which allows high pressure mud to be supplied to drilling pipes.

Document US2009114086A1 describes the compression of a useful gas by a compressor and the use of a pressurized barrier gas to reduce the leakage of useful gas.

Document US2005253340A1 discloses seal systems with seals engageable in sequence with movable elements, e.g. rotating and/or reciprocating shafts, through relative movement between a barrier element and the lip seal elements.

Object of the Invention

Disadvantageously, to maintain an adequate level of sealing and limit leakage, it is necessary to periodically intervene to restore the tightening of the closure element.

In addition, the pressurized contact between the packing fibres and the piston rod can damage the piston rod, causing it to wear faster.

In this context, the technical task underlying the present invention is to propose a seal for a reciprocating pump that overcomes the drawbacks of the above-mentioned known art.

In particular, it is an object of the present invention to provide a seal for a reciprocating pump that requires a lower number of maintenance operations.

It is also an object of the present invention to provide a pump which ensures a longer life of the piston.

The mentioned technical task and the specified aims are substantially achieved by a seal for a reciprocating pump, comprising the technical specifications set out in one or more of the appended claims.

Advantageously, the seal for a reciprocating pump comprises sealing rings inside the casing, held adhered to the piston rod by elastic elements. In particular, the sealing rings are designed to recover the wear, and, after the initial period of starting the reciprocating pump, they reach their optimum operating zone and are kept in place by the elastic elements.

Advantageously, the sealing rings exert a much smaller rubbing action on the piston rod than the packing, ensuring an adequate level of sealing and, at the same time, significantly limiting the wear on the piston rod.

LIST OF FIGURES

Further features and advantages of the present invention will become more apparent from the description of an exemplary, but not exclusive, and therefore non-limiting preferred embodiment of a seal for a reciprocating pump, as illustrated in the appended figures, in which.

Figure 3:
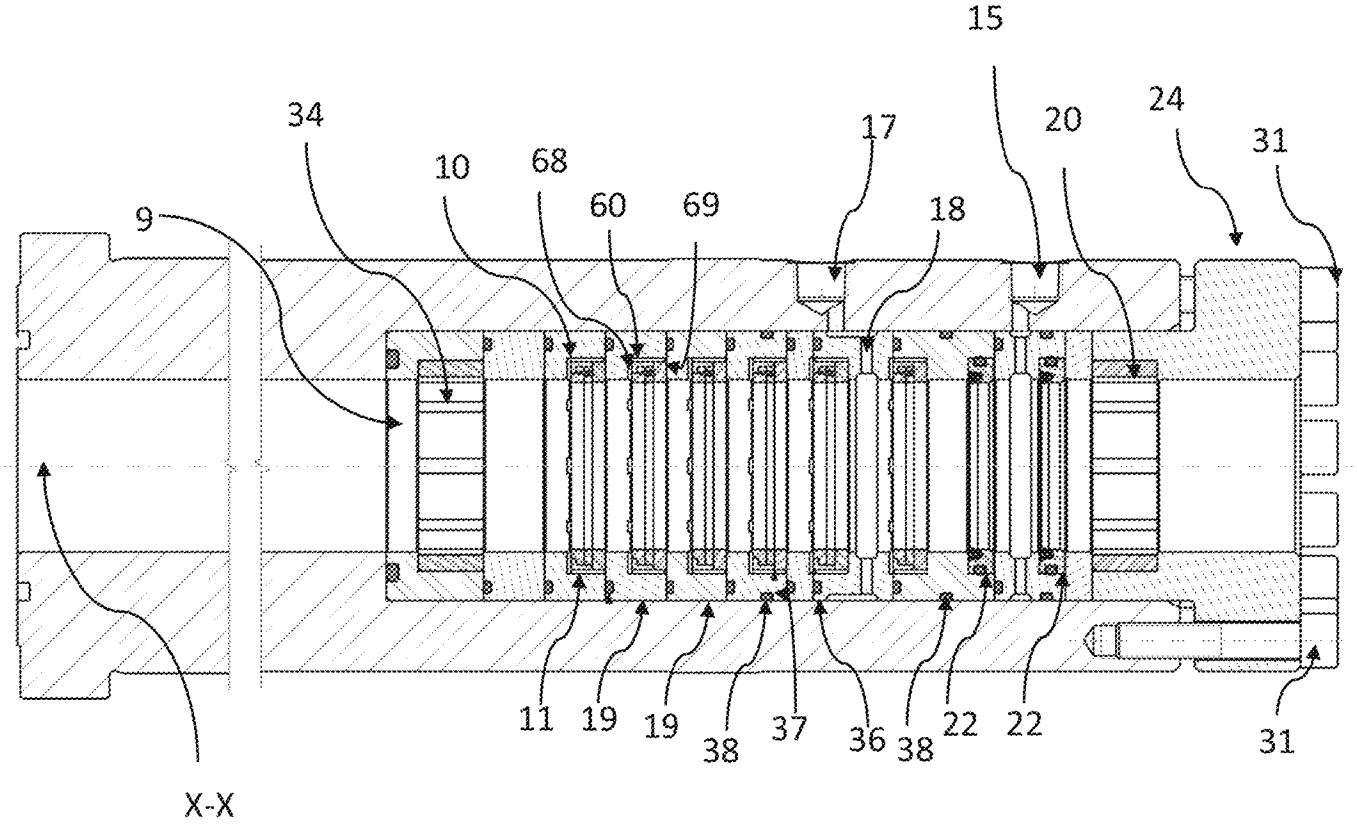
FIG. 3 is a second embodiment of a seal according to the present invention.
Figure 3A:
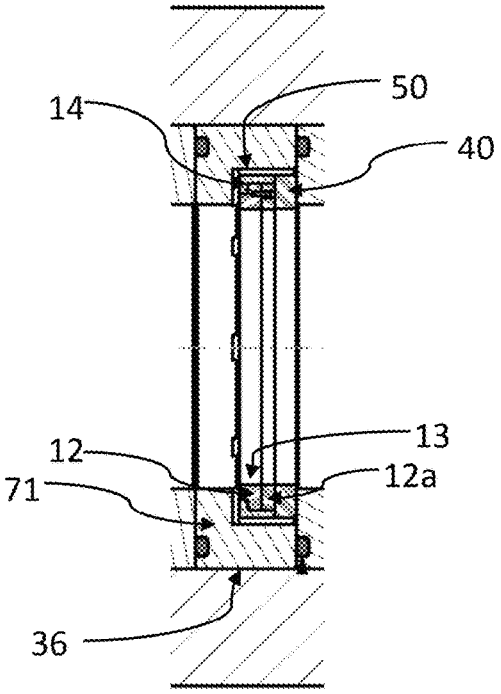
Figure 3B:
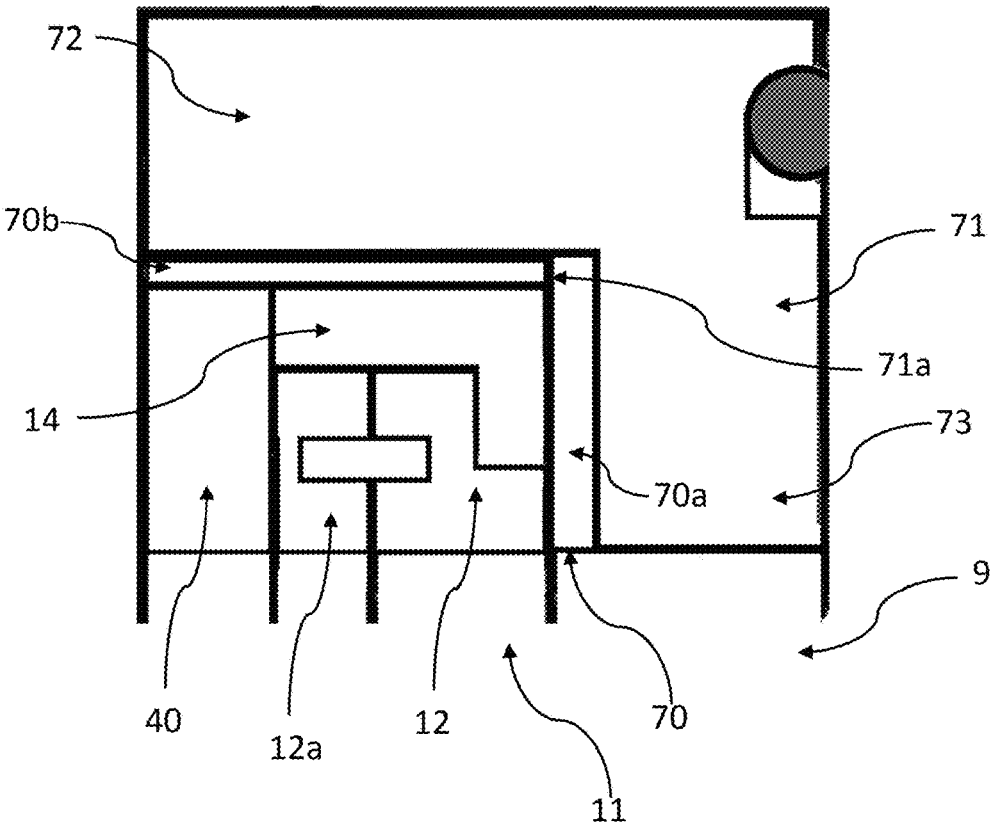

FIG. 3*a* is an enlargement of a portion of a casing from FIG. 3;

FIG. 3*b* is an enlarged view of a detail from FIG. 3*a;*

Figure 1:
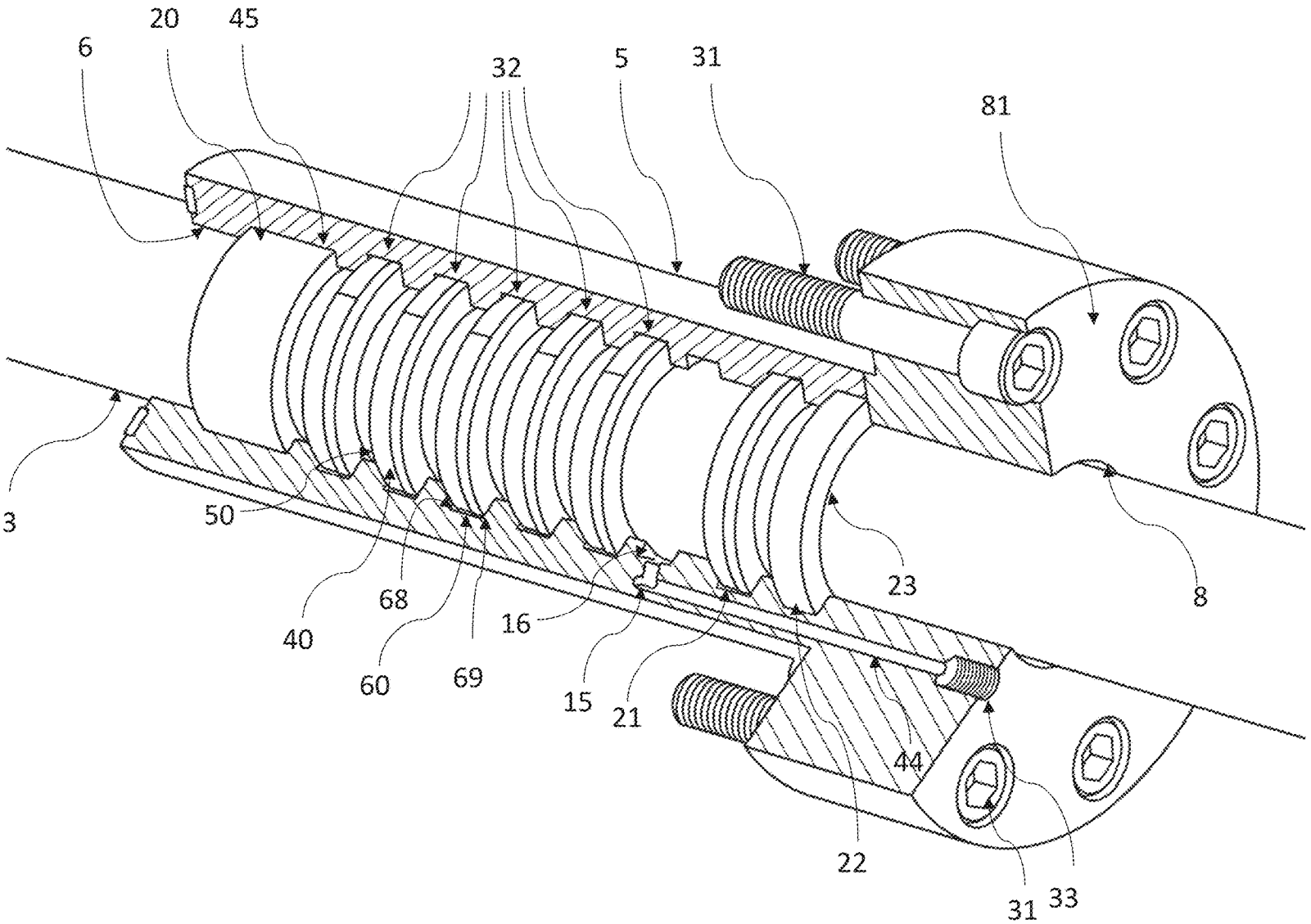
FIG. 1 is a perspective view of a section of a first embodiment of a seal according to the present invention.
Figure 4:
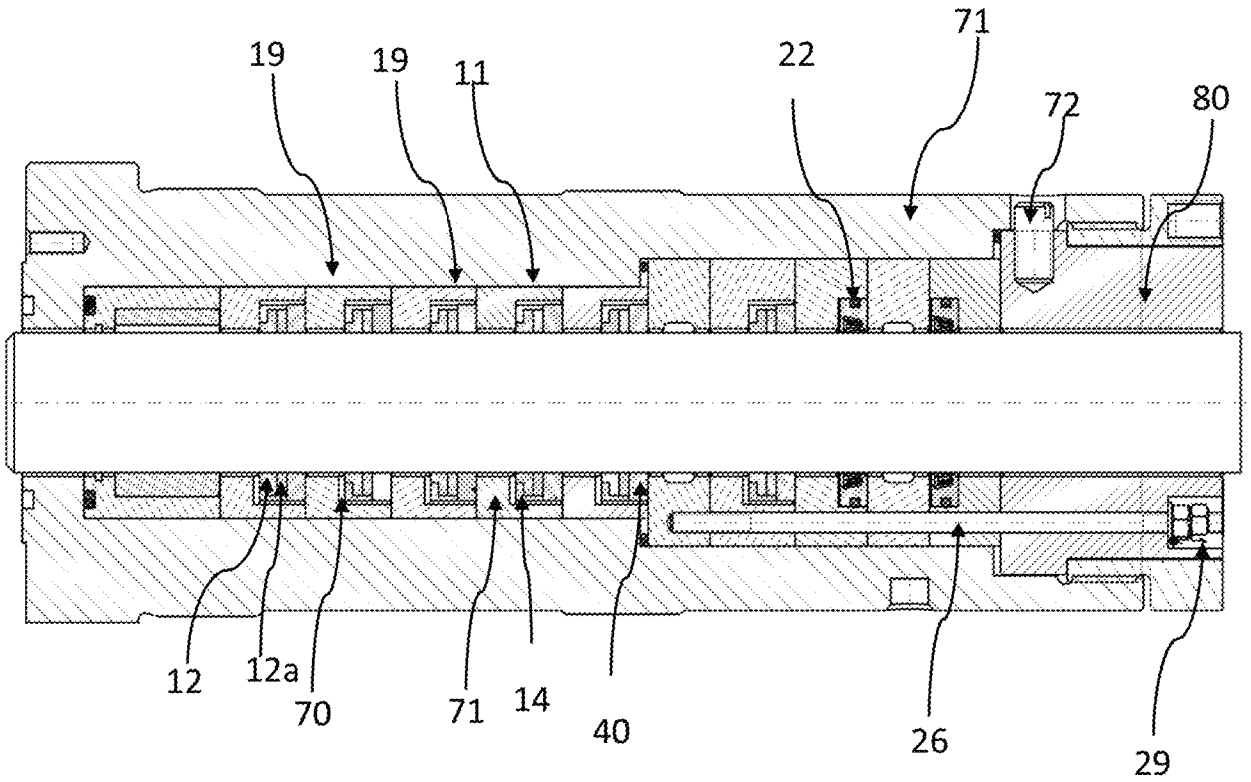
Figure 5:
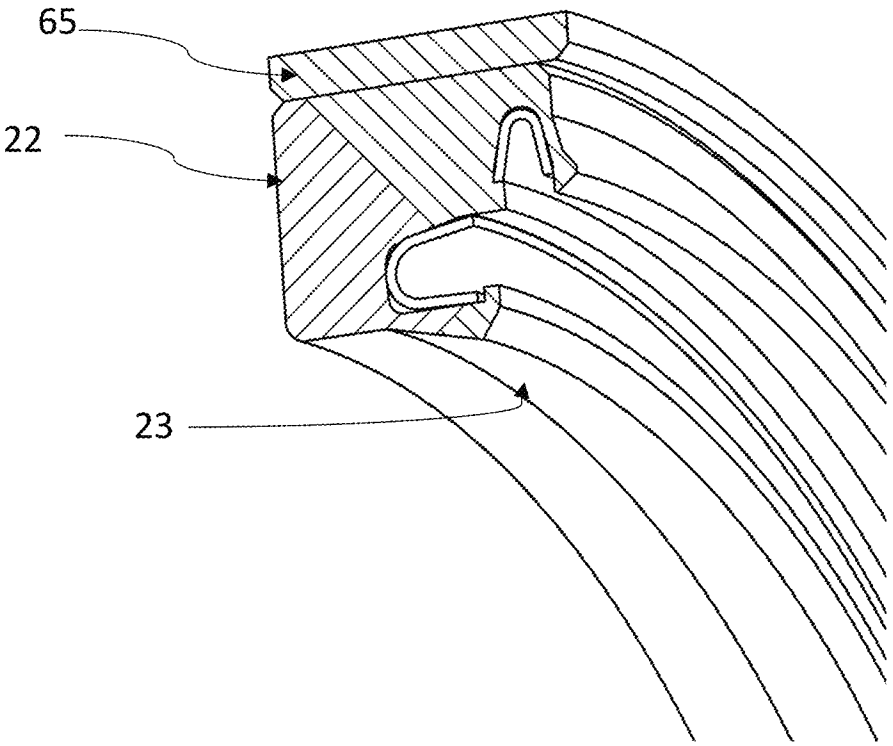
Figure 6:
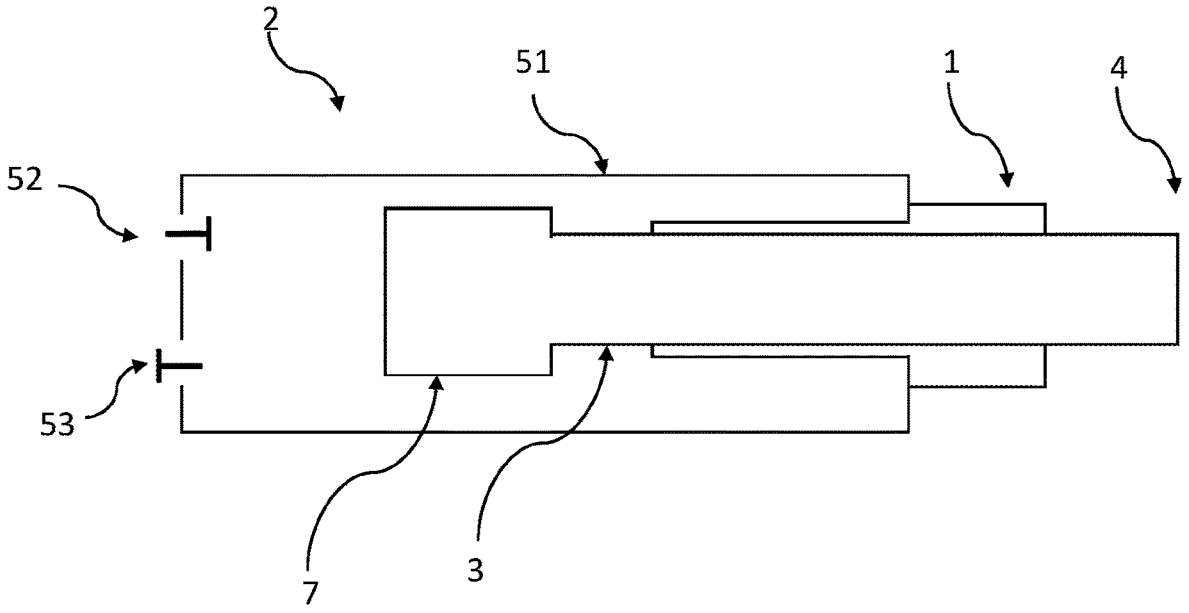

FIG. 4 is a third embodiment of a seal according to the present invention;

FIG. 5 is a sectional perspective view of a detail of the seal in FIG. 1; and FIG. 6 is a schematic side view of a reciprocating pump.

DETAILED DESCRIPTION

The present invention relates to a seal 1 for a reciprocating pump 2 that can be applied to a rod 3 of a piston 4.

In detail, the reciprocating pump 2, shown schematically in FIG. 6, comprises at least one barrel 51 configured to contain the working liquid. The barrel 51 comprises an input valve 52, configured to input the working liquid into the barrel 51, and an output valve 53, configured to output the working liquid from the barrel 51. The inlet valve 52 and the outlet valve 53 open alternately. The reciprocating pump 2 comprises at least one piston 4 sliding inside the barrel 51 along the main development axis X-X. The reciprocating pump 2 also comprises a seal 1 applied to the rod 3 of the piston 4. In particular, the reciprocating pump 2 comprises an opening 54. The seal 1 is applied to the opening 54.

Figure 2:
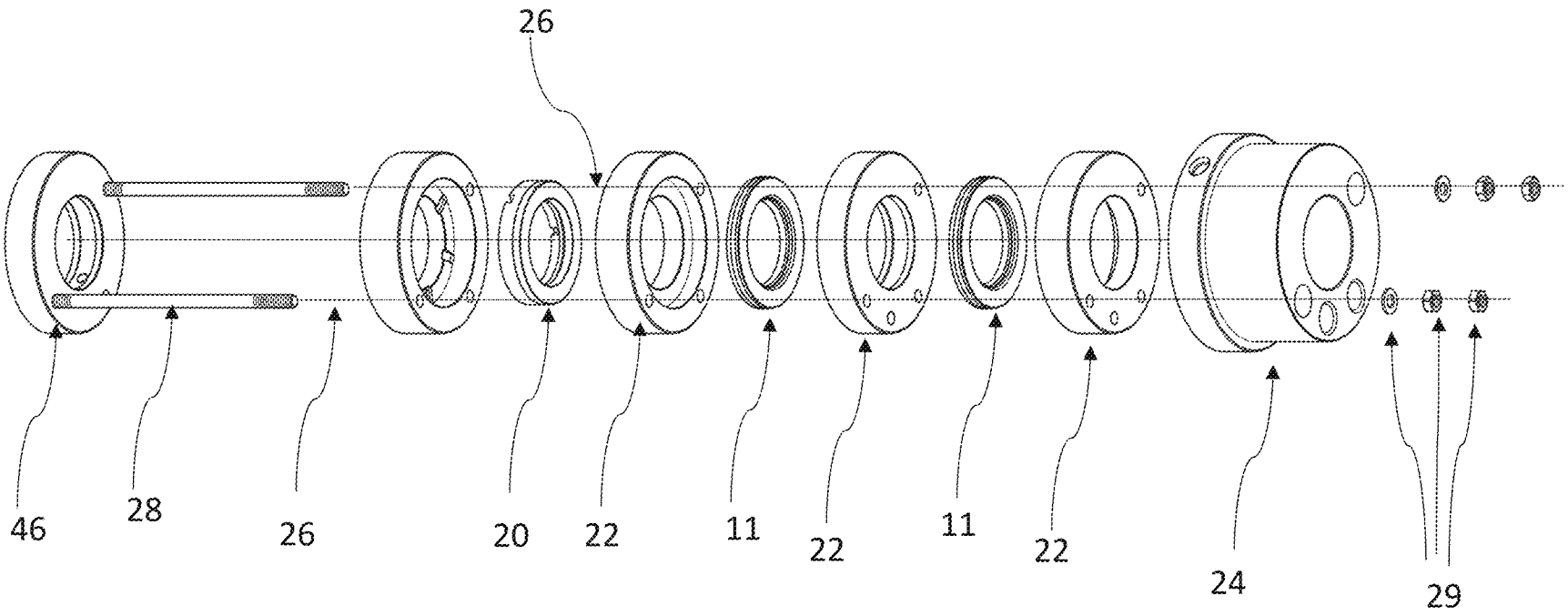
FIG. 2 is an exploded side view of some of the seal components from FIG. 1.

As shown in FIG. 1, the seal 1 comprises a casing 5, which extends along a main development axis X-X. Preferably, the casing 5 has the function of a gland seal. The casing 5 comprises a first opening 6, facing a head 7 of a piston 4, and a second opening 8 opposite the first opening 6. The first 6 and the second opening 8 are arranged along the main development axis X-X. Furthermore, the casing 5 defines a main cavity 9 that develops between the first 6 and the second opening 8. The rod 3 of the piston 4 is slidable within the main cavity 9 and passes through the first 6 and the second opening 8. In one embodiment, shown in FIG. 2, the casing 5 comprises a bottom portion 46 at the first opening 6.

The casing 5 comprises an outer surface 36 and a plurality of annular seats 37 distributed along the main development axis X-X and located at the outer surface 36.

It should be noted that the casing 5 has a plurality of annular housings 10 distributed along the main development axis X-X. In addition, the annular housings 10 are located externally and are concentric with respect to the main cavity 9. Each annular housing 10 comprises a first 68 and a second wall 69, spaced along the main development axis X-X, and an annular wall 60, positioned between the first and second walls 68, 69. In the embodiment shown in FIG. 1 the number of annular housings 10 is at least six.

In alternative embodiments of the invention, the annular housing 10 is defined by an external ring 71, described hereinafter in the present description.

In more detail, the casing 5 comprises a plurality of portions 19. Each portion 19 comprises a respective annular housing 10. It should be noted that, preferably, in each portion 19, the annular housing 10 is positioned so as to directly face one of the adjacent portions 19.

The seal 1 further comprises a plurality of sealing modules 11. Each sealing module 11 comprises a sealing ring 12 and an elastic member 14, as shown in FIG. 3*a*.

The sealing ring 12 is inserted in a respective annular housing 10 and has an inner surface 13, configured to be brought into contact with the rod 3 of the piston 4. In greater detail, the sealing ring 12 is a ring made of polymeric material. It should be noted that each sealing ring 12 is configured to allow a local decrease in pressure of a working liquid with respect to the next sealing ring 12 along the main development axis X-X from the first opening 6 towards the second opening 8. The flow of the working liquid is laminar along the main development axis X-X from the first opening 6 towards the second opening 8. Preferably, the sealing ring 12 has an L-shaped section.

Preferably, each sealing module 11 comprises a further sealing ring 12*a* configured to be brought into contact with the rod 3 of the piston 4.

The elastic member 14 is inserted in a respective annular housing 10 and is arranged externally and in contact on the respective sealing ring 12. The elastic member 14 is configured to hold the inner surface 13 of the respective sealing ring 12 adhering to the rod 3 of the piston 4. The elastic element 14 has an outer surface 50 facing the annular wall 60 of the annular housing 10. The elastic member 14 is made of steel. Preferably, the elastic member 14 has an L-shaped section, shaped to be complementary to that of the sealing ring 12, as shown in FIG. 3*b*.

Each sealing module 11 comprises a passage channel 70 arranged in the annular housing 10 externally to the elastic member 14. The passage channel 70 is placed in fluid communication with the main cavity 9. The passage channel 70 is configured to receive a working liquid from the main cavity 9.

Preferably, each sealing module 11 comprises the aforementioned external ring 71. Preferably, the external ring 71 has an inner surface 71*a* facing the resilient element 14.

Preferably, the external ring 71 has an L-shaped section. Preferably, the external ring 71 has a first portion 72 parallel to the main development axis X-X and a second portion 73 orthogonal to the main development axis X-X. Preferably, each external ring 71 has at least one passage channel 70 at the second portion 73.

Preferably, the passage channel 70 has a groove 70*a* extending from the main cavity 9 orthogonally with respect to the main axis X-X, at the external ring 71. In the preferred embodiment, the groove 70*a* extends from the main cavity 9 at the second portion 73 of the external ring 71. The groove 70*a* is placed between the second portion 73 of the external ring 71 and the elastic member 14. Advantageously, during use, the working liquid exerts a pressure parallel to the main development axis X-X, on the respective sealing module 11.

Preferably, the passage channel 70 has a gap 70*b* in fluid communication with the groove 70*a*. Preferably, the gap 70*b* is placed between the external ring 71 and the elastic member 14. Preferably, the gap 70*b* is placed between the first portion 72 of the external ring 71 and the elastic member 14. In other words, the gap 70*b* is located in the annular housing 10 portion which remains free externally to the elastic member 14. Advantageously, during use, the working liquid flows from the central cavity 9 into the groove 70*a* and into the gap 70*b* to exert a radial pressure on the respective sealing module 11, and in particular on the elastic member 14, guaranteeing adhesion on the piston 4.

In a preferred embodiment, the seal 1 comprises a plurality of support rings 40. It should be noted that each support ring 40 is inserted in a respective annular housing 10. In particular, each support ring 40 is positioned in contact with a respective sealing module 11 along the main development axis X-X. In the embodiment shown, each support ring 40 is positioned so as to be closer to the second opening 8 than the respective sealing module 11. In a preferred embodiment, the support ring 40 is made of polymeric material. It should be noted that the sealing module 11 and the respective support ring 40 are made to be respectively in contact with the first and second walls 68, 69 of the annular housing 10.

Preferably, each further sealing ring 12*a* is arranged between the sealing ring 12 and a respective support ring 40.

With particular reference to FIGS. 1 and 3, the casing 5 comprises at least one drain channel 15, placed in fluid communication with the main cavity 9. The drain channel 15 is configured to drain the working liquid from the main cavity 9. In particular, the drain channel 15 comprises an inlet 16, positioned between two sealing modules 11.

The drain channel 15 is configured to receive the residual working liquid within the main cavity 9. It should be noted that the drain channel 15 has a straight section 44, external to the main cavity 9 and extending parallel to the main development axis X-X. The inlet 16 connects the straight section 44 to the main cavity 9. In a preferred embodiment, the straight section 44 of the drain channel 15 has a drain opening 33 projecting outside the casing 5, in proximity to the second opening 8. The drain opening 33 is configured to expel the residual working liquid. Preferably, the residual working liquid is collected and re-introduced into the reciprocating pump 2.

The inlet 16 defines a first 32 and a second set of sealing modules 21. In particular, the first group of sealing modules 32 is positioned between the inlet 16 and the first opening 6. The second set of sealing modules 21 is positioned between the inlet 16 and the second opening 8. In the embodiment shown in FIG. 1, there are five sealing modules 11 of the first set of sealing modules 32. In the embodiment shown in FIG. 1, the sealing modules 11 of the first set of sealing modules 32 are equally spaced along the main development axis X-X. In the embodiment shown in FIG. 1, the second set of sealing modules 21 comprises at least one sealing module 11.

The seal 1 comprises a second drain channel 17 having a second inlet 18. The second inlet 18 projects into the main cavity 9 and is positioned between the inlet 16 and the first opening 6. In a preferred embodiment, shown in FIG. 2, the second inlet 18 is positioned between two consecutive sealing modules of the second set of sealing modules 21. Advantageously, it is possible to schedule the maintenance of the seal 1 when a leakage of the working liquid from the second drain channel 17 is detected.

The seal 1 comprises at least one bushing 20, configured to hold the rod 3 of the piston 4 aligned inside the main cavity 9. The bushing 20 is positioned between the first opening 6 and the first set of sealing modules 32 or between the second opening 8 and the second set of sealing modules 21. Preferably, the bottom portion 46 comprises a bushing seat 45 and the bushing 20 is mounted to the bushing seat 45 by interference.

In a preferred embodiment, shown in FIG. 3, the seal 1 comprises two bushings 20. Each bushing 20 is positioned between the first opening 6 and the first set of sealing modules 32 and between the second opening 8 and the second set of sealing modules 21. In a preferred embodiment, the bushing 20 is made of polymeric material.

In a preferred embodiment, each bushing 20 has at least one axial groove 34 facing the rod 3 of the piston 4 and oriented parallel to the main development axis X-X. The axial groove 34 is configured to reduce the pressure inside the main cavity 9, allowing the passage of the working fluid. In other words, the bushings 20 provided with axial grooves 34 do not act as sealing elements. Preferably, the number of axial grooves 34 is comprised between four and eight, even more preferably is equal to six.

The seal 1 comprises an insulating ring 22, positioned between the second opening 8 and the second set of sealing modules 21. In the embodiment in which the seal 1 comprises the bushing 20 positioned between the second opening 8 and the second set of sealing modules 21, the insulating ring 22 is preferably positioned between said bushing 20 and the second set of sealing modules 21. The insulating ring 22 has an inner insulating surface 23 configured to be brought into contact with the rod 3 of the piston 4. Preferably, the insulating ring 22 is defined by a double lip ring. In a preferred embodiment, each insulating ring 22 is made of a polymeric material. In a preferred embodiment, the insulating ring 22 is inserted into an outer shell 65, configured to confer a necessary level of stiffness. Preferably, the outer shell 65 is made of steel.

The seal 1 further comprises a plurality of elastomeric rings 38 and each elastomeric ring 38 is inserted into a respective annular seat 37.

The seal 1 comprises a fastening element 24 placed at the second opening 8. The casing 5 comprises a tightening channel 26 passing through each portion 19 and configured to receive a tie rod 28, which can be tightened by tightening means 29 and configured to hold the portions 19 of the casing 5 together. Note that the bottom 46 of the casing 5 comprises an additional clamping channel, not shown in the figures. In particular, the further clamping channel is configured to align with the clamping channel 26. Preferably, the clamping channel comprises a thread (also not shown in the attached figures), configured to fix the tie rod 28 to the bottom 46. In a preferred embodiment, the clamping means 29 comprise a washer and at least one nut.

It should be noted that, in a first embodiment shown in FIG. 4, the fastening element 24 is defined by a ring nut 80 which can be coupled to the casing 5 by means of a thread. The ring nut is made of steel. In particular, the casing 5 comprises a support 71 comprising a clamping ring nut, configured to couple with the thread of the casing 5. Furthermore, in a preferred embodiment, the seal 1 comprises at least one anti-rotational pin 72, inserted in the support 71 and abutting the ring nut. The anti-rotational pin 72 is configured to hold the ring nut in position.

In a second embodiment shown for example in FIG. 1, the fastening element 24 is defined by a flange 81 which can be coupled to the casing 5 by means of bolts 31. The number of bolts 31 is comprised between twelve and eighteen and is preferably equal to fifteen and the bolts 31 are arranged along a circumference. The flange is made of steel.

The invention claimed is:

1. A seal for a reciprocating pump adapted to be applied to a rod of a piston, the seal comprising:

a casing extending along a main development axis and comprising a first opening designed to face a head of a piston, and a second opening opposite the first opening, both arranged along the main development axis, the casing defining a main cavity extending between the first opening and the second opening, the rod of the piston being able to slide within the main cavity and through the first opening and the second opening, the casing further having a plurality of annular housings distributed along the main development axis, the annular housings being arranged external to and concentric with the main cavity, a plurality of sealing modules each comprising a sealing ring inserted in a respective annular housing and having an inner surface, configured to contact the rod of the piston, an elastic member inserted in a respective annular housing and arranged external to and in contact with its respective sealing ring, the elastic member being configured to force the inner surface of its respective sealing ring to adhere to the rod of the piston, wherein the casing comprises at least one drain channel in fluid communication with the main cavity, the drain channel being configured to drain a working liquid from the main cavity.

2. A seal as claimed in claim 1, wherein each sealing module comprises at least one passage channel placed between the elastic member and the respective annular housing in fluid communication with the main cavity, the passage channel being shaped to receive working liquid from the main cavity.

3. A seal as claimed in claim 2, wherein each sealing module comprises an external ring, the passage channel comprising a groove, extending from the main cavity, orthogonally to the main development axis, at the external ring.

4. A seal as claimed in claim 3, wherein the passage channel comprises a gap placed between the external ring and the elastic member, in fluid communication with the groove.

5. A seal as claimed in claim 1, wherein the sealing ring has an L section and the elastic member has an L section, shaped to be complementary to that of the sealing ring.

6. A seal as claimed in claim 1 wherein the drain channel comprises an inlet located between two successive sealing modules, the inlet defining a first set of sealing modules located between the inlet and the first opening, and a second set of sealing modules, located between the inlet and the second opening.

7. A seal as claimed in claim 6 wherein the casing comprises a second drain channel having a second inlet projecting into the main cavity, located between the inlet and the first opening.

8. A seal as claimed in claim 6 comprising at least one bushing located between the first opening and the first set of sealing modules and/or between the second opening and the second set of sealing modules, the bushing being configured to keep the rod of the piston aligned within the main cavity.

9. A seal as claimed in claim 6, wherein the seal comprises an insulating ring located between the second opening and the second set of sealing modules, the insulating ring having an insulating inner surface configured to contact the rod of the piston, the insulating ring being preferably defined by a double-lip ring.

10. A seal as claimed in claim 1, wherein the casing comprises a plurality of portions, each portion comprising a respective annular housing.

11. A seal as claimed in claim 10, comprising a fastening element located at the second opening, the casing comprising a locking channel extending through each portion, the locking channel being configured to receive a tie rod designed to be locked by means of locking means and being configured to hold the portions of the casing together.

12. A seal as claimed in claim 11, wherein the fastening element is defined by a ring nut designed to be coupled to the casing by means of a screw thread.

13. A seal as claimed in claim 11, wherein the fastening element is defined by a flange designed to be coupled to the casing by means of bolts.

14. A seal as claimed in claim 1, wherein the casing comprises an outer surface, at least one annular seat distributed along the main development axis and located at the outer surface, the seal comprising at least one elastomeric ring, each elastomeric ring being inserted in a respective annular seat.

15. A reciprocating pump comprising:

at least one barrel configured to contain the working liquid;

at least one piston sliding within the barrel along the main development axis and comprising a rod;

a seal as claimed in claim 1 applied to the rod of the piston.

16. A seal for a reciprocating pump adapted to be applied to a rod of a piston, the seal comprising:

a casing extending along a main development axis and comprising a first opening designed to face a head of a piston, and a second opening opposite the first opening, both arranged along the main development axis, the casing defining a main cavity extending between the first opening and the second opening, the rod of the piston being able to slide within the main cavity and through the first opening and the second opening, the casing further having a plurality of annular housings distributed along the main development axis, the annular housings being arranged external to and concentric with the main cavity; a plurality of sealing modules each comprising a sealing ring inserted in a respective annular housing and having an inner surface, configured to contact the rod of the piston;

an elastic member inserted in a respective annular housing and arranged external to and in contact with its respective sealing ring, the elastic member being configured to force the inner surface of its respective sealing ring to adhere to the rod of the piston;

wherein the casing comprises at least one drain channel in fluid communication with the main cavity, the drain channel being configured to collect and drain a working liquid that has leaked past at least one of said sealing modules from the main cavity.

* * * * *